United States Patent [19]

Boretti

[11] Patent Number: 4,736,469

[45] Date of Patent: Apr. 12, 1988

[54] HEADGEAR FOR SLALOM RACERS

[76] Inventor: Gianromano Boretti, Via Poggio Vittorio 29, I-50055 Lastra a Signa (Firenze), Italy

[21] Appl. No.: 930,290

[22] PCT Filed: Feb. 13, 1986

[86] PCT No.: PCT/EP86/00067

§ 371 Date: Oct. 14, 1986

§ 102(e) Date: Oct. 14, 1986

[87] PCT Pub. No.: WO86/04791

PCT Pub. Date: Aug. 28, 1986

[30] Foreign Application Priority Data

Feb. 18, 1985 [IT] Italy ..... 53000/85[U]

[51] Int. Cl.[4] ..... A42B 1/12; A42B 3/00

[52] U.S. Cl. ..... 2/411; 2/425

[58] Field of Search ..... 2/411, 425

[56] References Cited

U.S. PATENT DOCUMENTS 3,904,469 9/1975 Dickstein ..... 2/425
4,168,542 9/1979 Small ..... 2/425 X
4,612,672 9/1986 Schrack ..... 2/411 X

FOREIGN PATENT DOCUMENTS 0096148 12/1983 European Pat. Off. ..... 2/411
3005133 8/1981 Fed. Rep. of Germany ..... 2/425
1374284 8/1964 France ..... 2/411

*Primary Examiner*—Louis K. Rimrodt
*Attorney, Agent, or Firm*—Sughrue, Mion, Zinn, Macpeak, and Seas

[57] ABSTRACT

The headgear comprises at least one annular band for surrounding the head and possibly completed by a cap. At least the frontal-lateral part of the band includes a thick, shock-absorbent structure of resiliently-compressible foamed material. This structure is covered externally by a flexible surface layer which is resistant to abrasion and is formed as a peak having such a shape in plan as to project in correspondence with the forehead and the temporal zones to such an extent as to shield all parts of the face and any goggles respectively, from frontal blows and the ears from glancing and lateral blows.

8 Claims, 2 Drawing Sheets

HEADGEAR FOR SLALOM RACERS

The present invention relates to headgear for slalom racers.

In slalom competitions, the winding course is indicated by gates defined by pairs of poles whose bases are flexible to allow the poles to bend without breaking or becoming uprooted.

As in all speed trails, a downhill skier in the slalom also tries to follow the shortest possible route in order to gain even the smallest fractions of a second. In passing through the gates, the downhill skier passes as close as possible to the pole which is on the inside of the curve and/or closest to the next gate and in fact uses his arm and/or leg to push the pole aside so as to graze the base with his ski. However, this manoeuvre causes the skier to lose his balance, which makes him lose speed and reduces or cancels out the benefit arising from the choice of the shorter route.

The object of the present invention is to provide a device which protects the face and head of a slalom racer from frontal and lateral impacts, and enables him to take the maximum advantage from the possibility of grazing the poles and moving them aside without thereby losing speed.

According to the present invention this object is achieved by means of headgear for slalom racers, characterised in that it comprises at least one annular band for encircling the head, at least the frontal-lateral part of which comprises a thick structure of resiliently-compressible foamed material for absorbing shocks, this structure being covered externally by a flexible abrasion-resistant surface layer and having the form of a peak with such a shape in plan as to project in correspondence with the forehead and temporal zones through such an extent as to shield all parts of the face and any goggles from frontal blows and the ears from glancing and lateral blows.

Figure 1:
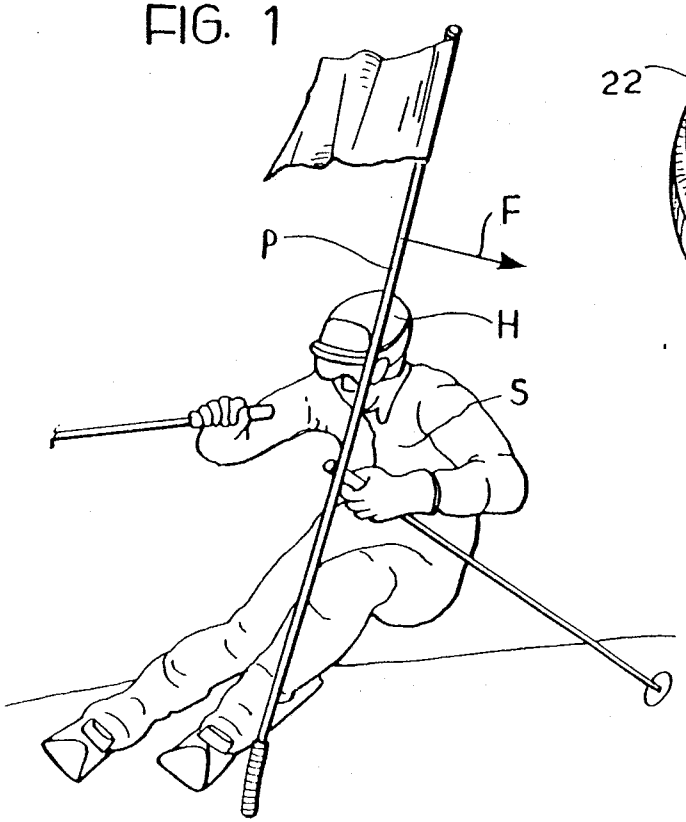

FIG. 1 of the appended drawings is a pictorial representation of a slalom racer in a competition, wearing headgear according to the invention.

As illustrated in FIG. 1, a slalom racer S having the headgear H according to the invention may push directly at the pole P of a gate and move it aside (arrow F) with a blow from his head, without making a movement of his arms or legs which would reduce his downhill speed.

The thick frontal-lateral structure of foamed material may be formed with an optimum density for giving the pole P a deflecting blow such as to move it out of the way of the head and body of the skier, and at the same time for absorbing the shock as a result of deformation of the foamed material so that the skier's head does not feel the blow.

The effectiveness of the device according to the invention is confirmed by the splendid results achieved after the priority date of the present patent application, by athletes of several national teams in the 1985–86 skiing season.

Countless rigid, semi-rigid and soft types of headgear, with or without peaks, are known from the prior art for dangerous work, sports activities, children, etc.

Examples of known rigid helmets with rigid peaks are illustrated in U.S. Pat. No. 3,353,188 and U.S. Pat. No. 3,514,787.

Examples of known non-rigid types of headgear with rigid peaks are illustrated in U.S. Pat. No. 2,218,947, U.S. Pat. No. 3,353,188 and U.S. Pat. No. 3,514,737.

Examples of known soft shock-resistant headgear having thin peaks with an indeterminate shape in plan are illustrated in FR-A-2294659 and DE-U-1948509.

Examples of soft shock-resistant headgear without peaks are known from U.S. Pat. No. 2,391,335, U.S. Pat. No. 2,969,547 and De-U-7507120.

A protective device for the heads of baseball players and the like is also known from U.S. Pat. No. 2,143,483, which consists of a sponge rubber ring with a thickened zone which the player can orientate in the direction from which he expects the ball to arrive.

All these known types of headgear have the sole function of protecting the wearer's head in a passive manner against impacts of the head in movements against a stationary object and/or against blows from an object moving towards the head. However, they do not provide for the possibility of the head giving an object a specific movement for a predetermined purpose.

The headgear according to the invention, however, has the function of a piece of active sports equipment since it serves to give an object (the pole) a desired movement by making use of part of the body (the head) and protecting this part of the body just as the football boot serves to give an object (the ball) a desired movement by making use of part of the body (the foot) and protecting that part of the body.

A rigid helmet is by nature sonorous, that is to say, it transmits the noise of the blows it receives to the head. It has the sole function of protecting the head against occasional knocks. In such a case, it is not important that the noise of the knock is perceived to a greater or lesser degree by the wearer of the helmet.

In a slalom competition, a skier wearing a rigid helmet and wishing to deflect the poles of the gates would inevitably be stunned by the repeated blows.

In order to have an idea of the impossibility of using a rigid helmet for the purposes of the invention, it is necessary to consider that a special slalom course includes about sixty gates and is completed in a time of about 50 seconds, which, with the use of the technique allowed by the invention, corresponds to a rate of more than one blow per second.

Even non-rigid headgear having a rigid visor for allowing the poles to be knocked would give a slalom racer similar problems to those given by a rigid helmet.

The subject of the invention will be better understood from the detailed description which follows with reference to the further appended drawings, provided by way of non-limiting example and in which:

FIG. 1 of the appended drawings is a pictorial representation of a slalom racer in a competition, wearing headgear according to the invention.

Figure 2:
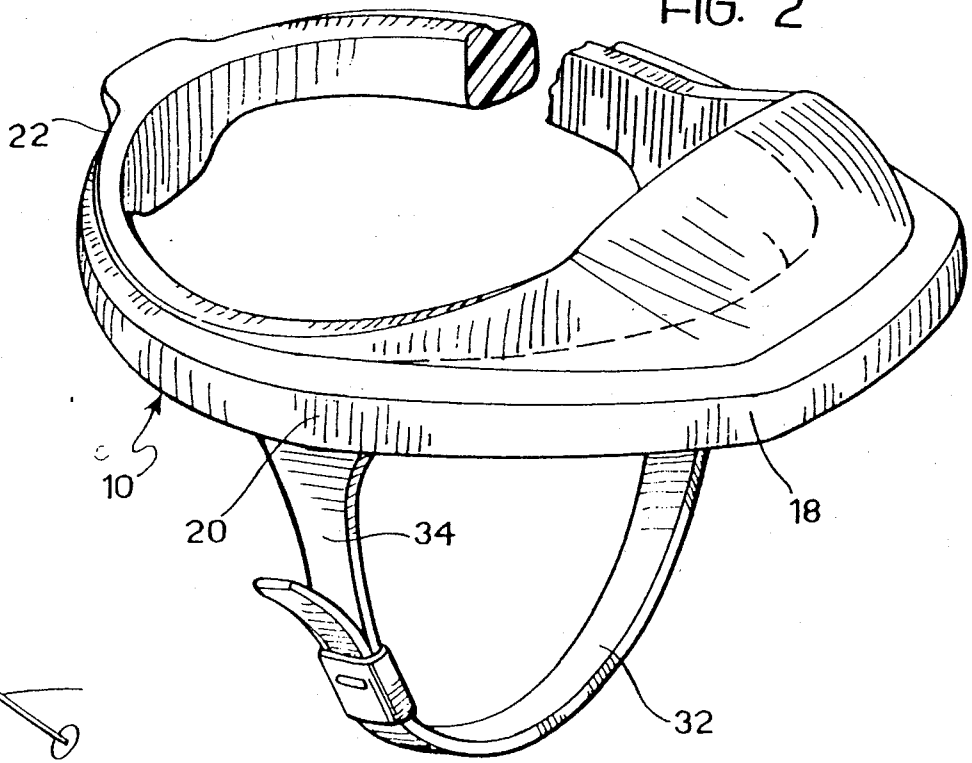
Figure 3:
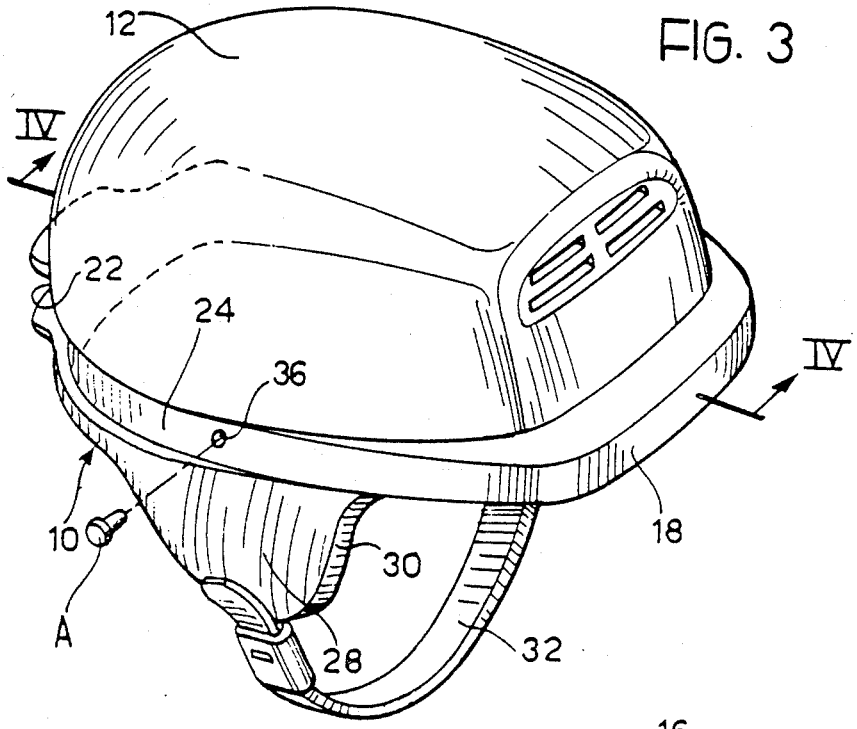
Figure 4:
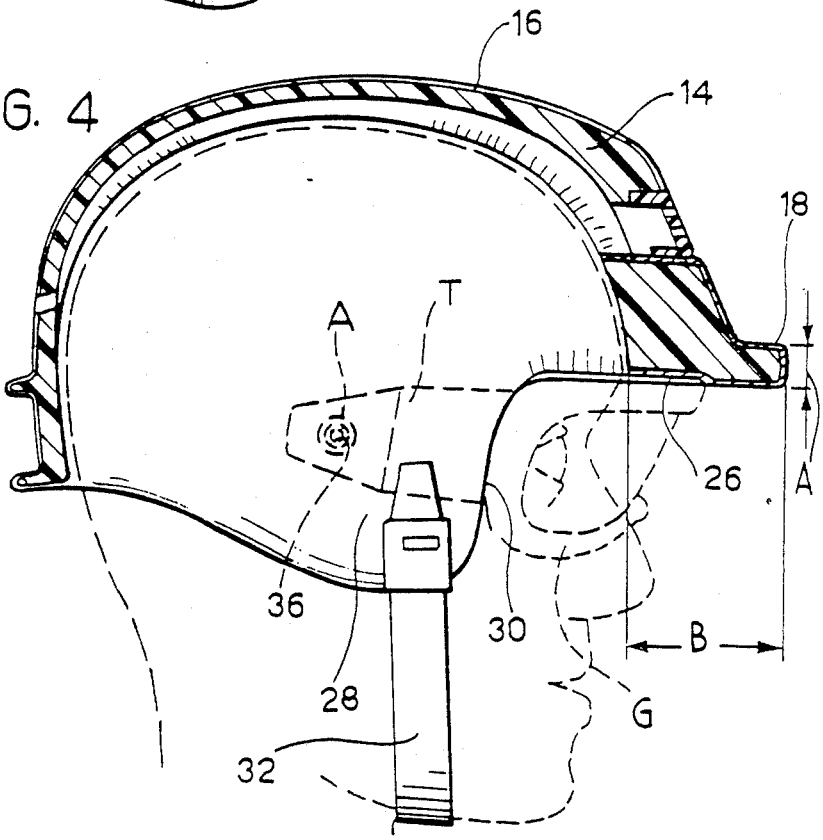

FIG. 2 is a perspective view of a first embodiment of the headgear of the invention, FIG. 3 is a perspective view of a second embodiment of the headgear of the invention, FIG. 4 is a median section taken on the line IV—IV of FIG. 3, in which the head of a skier with goggles is also shown.

The headgear illustrated in FIG. 2 consists essentially of an annular band, generally indicated 10. The annular band 10 is preferably constituted by an integral member of foamed material which can be worn in the form of a pad on the head.

Alternatively, as illustrated in FIGS. 3 and 4 the annular band 10 may be formed integrally with a cap 12 of the same foamed material to constitute a hat.

In the case of a hat such as that of FIGS. 3 and 4 the general structure may be similar to that described and illustrated in the application PCT/EP85/00727 filed on Dec. 20, 1985 by the same applicant, which is incorporated herein as a reference.

Whether one considers a simple annular band or a hat, the soft foamed material preferred is polyethylene, polyurethane or an ethylene-vinyl acetate copolymer. The foamed material has, at least externally, a flexible surface layer which is resistant to abrasion. This surface layer may be a skin, preferably constituted by a plastisol separate from the foamed material and adhering thereto or by an outer denser layer formed integrally with the foamed material.

Alternatively, the surface layer may be a resilient varnish.

Whatever the foamed material used, it must have the property of absorbing shocks by compression and of dissipating the energy of the impact during the compression and subsequent expansion. The skin must be resistant to abrasion both to protect the foamed material and to preserve the aesthetic appearance of the device in spite of the knocks.

In FIG. 4 the foamed material is indicated 14 and the surface layer 16.

Whether one considers a simple annular band as in FIG. 2 or a hat as in FIGS. 3 and 4, the device includes a frontal-lateral part 18 formed as a peak. This part 18 is a thick structure constituted by the soft, shock-absorbent, resiliently-compressible foamed material. The peak 18 has such a shape in plan as to project in correspondence with the forehead and the temporal zones to such an extent as to shield all the parts of the face (particularly the nose and the mouth) and the goggles from frontal blows and also to shield the ears against glancing and lateral blows.

In particular, in the embodiments shown, the peak or projecting part 18 has a thick lower projecting edge which extends rearwardly at 20, passing the temporal zones and closing into a ring in the occipital zone.

Optimum performance was obtained from headgear according to the invention with a thickened peak or projecting frontal-lateral part 18 in which the foamed material of the peak 14 was polyethylene having a density of 60 kg/m$^3$ and a thickness A (FIG. 4) of about 12 or 13 mm and which projected from the head by a distance B of about 50 mm.

To advantage, in the hat of FIGS. 3 and 4, the foamed material of the cap 12 has a lower density of about 20 kg/m$^2$ in order to lighten it.

In the rear zone, the lower edge has an outer channel 22 which, in the cap of FIGS. 3 and 4, extends forwardly along the sides at 24. This channel serves to receive and retain the tape of the goggles.

The lower surface of the peak constituted by the projecting part 18 is preferably formed with a recess 26 which acts as a seat for engaging the upper edge of the goggles G in order to prevent the goggles themselves from moving sideways as a result of the impacts.

Preferably, as can be seen in FIGS. 2 and 3, the peak 18 has a rounded form in plan for deflecting the poles of a slalom course laterally even when the skier hits them frontally.

Beneath the annular band 10, the hat of FIGS. 3 and 4 also includes thick ear-covering appendages 28 formed integrally and constituting both a protection against cold and further protection for the ears against blows. The appendages 28 have front edges 30 of a convex arcuate form for engagement with the lateral zones of the goggles G to provide further security against lateral movement of the goggles.

In order to retain the headgear firmly on the skier's head, a chin strap 32 may be provided and may be formed integrally with the headgear.

In FIG. 2 the chin strap 30 is connected to the band 10 in the temporal zones as indicated 34. In FIGS. 3 and 4 the chin strap 30 is connected to the ear-covering appendages 28.

To advantage, the hat of FIGS. 3 and 4 is provided with further means for attachment of a particular type of goggles G. As illustrated in FIG. 4, the goggles G have side strips T which are at least partly of resiliently extensible material. These strips are fixed to the hat by means of anchoring members A, such as screws or pins, inserted in lateral holes 36 formed in the temporal zones. This allows the skier to move the goggles away from the peak temporarily, for example for demisting, after which the goggles are returned to their positions by the resilient strips T.

The embodiments described and illustrated are not the only ones possible within the scope of the invention. Thus, according to the invention, a light protective device could be formed which is constituted by a hat of cloth or other material, at least the frontal-lateral part of which is constituted by a thick element of soft foamed material with a surface layer having a shape the same as or equivalent to that of the peak part indicated 18. Moreover, a frontal-lateral element of this type could form part of a band otherwise constituted by a strip.

I claim:

1. Headgear for slalom racers comprising at least one annular band for encircling the head, at least the frontal-lateral part of which comprises a thick structure of resiliently compressible foamed material for absorbing shocks, said structure being covered externally by a flexible abrasion-resistant surface layer and having the form of a peak, having a shape in plane as to project in correspondence with the forehead and temporal zones through such an extent as to shield all parts of the face and any goggles from frontal blows and the ears from glancing and lateral blows wherein said peak has a rounded shape in plan for laterally deflecting poles hit frontally and has a recess in the lower surface thereof which acts as a seat for engaging the upper edge of goggles so as to prevent the goggles from being displaced by blows.

2. Headgear according to claim 1 further comprising thick integral ear-covering appendages which have front appendages of convex arcuate form for engaging lateral zones of the goggles to provide further security against lateral movement of the goggles.

3. Headgear according to claim 1 further comprising means defining an external channel in the occipital zone for receiving a rear part of a tape for the goggles.

4. Headgear according to claim 1 further including means located in the temporal zones for attachment of side strips of the goggles.

5. Headgear according to claim 1 further including a chin strap connected to the headgear in the two temporal zones.

6. Headgear according to claim 1 wherein said annular band is formed integrally with a cap of the same foamed material having a flexible skin to define a light weight hat.

7. Headgear for slalom racers comprising at least one annular band for encircling the hea, at least the frontal lateral part of which comprises a thick structure of resiliently compressible foamed material for absorbing shocks, said structure being covered externally by a flexible abrasion-resistant surface layer and having the form of a peak having a shape in plan as to project in correspondence with the forehead and temporal zones through such an extent as to shield all parts of the face and any goggles from frontal blows and the ears from glancing and lateral blows, wherein said peak has a rounded shape in plan for deflecting laterally poles hit frontally and has lateral zones which extend rearwardly at least as far as the temporal zones.

8. Headgear according to claim 7 wherein the frontal-lateral peak part of said annular band is comprised of an integral member of foamed material having a flexible skin which can be worn on the head in the form of a pad.

* * * * *